US006148285A

United States Patent [19]

Busardo

[11] Patent Number: 6,148,285

[45] Date of Patent: Nov. 14, 2000

[54] ALLOPHONIC TEXT-TO-SPEECH GENERATOR

[75] Inventor: Philip John Busardo, Rochester, N.Y.

[73] Assignee: Nortel Networks Corporation, Ottawa, Canada

[21] Appl. No.: 09/183,002

[22] Filed: Oct. 30, 1998

[51] Int. Cl.[7] ..... G10L 13/00

[52] U.S. Cl. ..... 704/260; 704/258; 704/209

[58] Field of Search ..... 704/260, 258, 704/209

[56] References Cited

U.S. PATENT DOCUMENTS

| | | | |
|---|---|---|---|
| 4,398,059 | 8/1983 | Lin et al. . | |
| 4,602,152 | 7/1986 | Dittakavi . | |
| 4,618,985 | 10/1986 | Pfeiffer . | |
| 4,624,012 | 11/1986 | Lin et al. | 704/261 |
| 4,685,135 | 8/1987 | Lin et al. | 704/260 |
| 4,797,930 | 1/1989 | Goudie . | |
| 4,802,223 | 1/1989 | Lin et al. . | |
| 4,811,400 | 3/1989 | Fisher . | |
| 4,872,202 | 10/1989 | Fette . | |
| 4,979,216 | 12/1990 | Malsheen et al. | 704/260 |
| 5,384,893 | 1/1995 | Hutchins . | |
| 5,463,715 | 10/1995 | Gagnon | 704/267 |
| 5,488,652 | 1/1996 | Bielby et al. . | |
| 5,515,475 | 5/1996 | Gupta et al. . | |
| 5,530,740 | 6/1996 | Irribarren et al. . | |
| 5,644,680 | 7/1997 | Bielby et al. . | |

*Primary Examiner*—David R. Hudspeth
*Assistant Examiner*—Daniel Abebe
*Attorney, Agent, or Firm*—Jaeckle Fleischmann & Mugel, LLP

[57] ABSTRACT

The allophonic text-to-speech generator (ATTG) 10 includes a CPU 100. The CPU has a random access memory 102 and a read only memory 104 for holding the operating system, application programs, and data for the CPU 100. A keyboard 110 provides a user with control over the CPU 100. A database 130 holds phonetic transcritps of words. Such databases are well-known in the field of telephone directory assistance. A second database 140 maps allophonic text to parse and pre-recorded allophones. The CPU 100 converts a phonetic transcript of a word into an allophonic text string in accordance with a rules program 120. Then the CPU 100 extracts the audio allophone files of the allophonic string and concatenates the audio files to form the new word in the same voice as the other words fromed from the allophones in database 140.

6 Claims, 1 Drawing Sheet

ALLOPHONIC TEXT-TO-SPEECH GENERATOR

BACKGROUND

This invention relates in general to text-to-speech generators and, in particular, to an allophonic text-to-speech generator.

Many telephone assistance systems use pre-recorded words and announcements to assist callers. For example, a voice mail box may include a pre-recorded greeting with a space in the greeting for inserting the name of the mail box owner. Some systems are sophisticated enough to have a library of names that can be concatenated together from prerecorded voice files so that the same voice continuously speaks the announcement as well as the name of the called party.

Directory assistance systems are significantly more complex than voice mail systems. Directory assistance systems often require numerous individual announcements as well as a number of individual names, words, and phrases. These announcements, names, words and phrases must be recorded in advance. All recordings are made by one person so that the caller hears one voice.

It is time-consuming to create or modify existing announcement systems. In order to change any of the announcements or individual words, the audio file must be re-recorded. That may be impossible if the original voice talent who recorded the announcement is no longer available to make future recordings. Even if the voice talent is available, modifications are still labor-intensive. They require sessions for recording, editing and concatenating the talent's voice in order to generate the desired announcements and words.

Others have proposed text-to-speech generators (U.S. Pat. Nos. 4,872,202, 5,384,893, and 5,463,715) and systems that synthesize human voice from computer files (see, U.S. Pat. No. 4,602,152). The foregoing references show that it is possible to convert orthographic text into phonetic text and into speech, nevertheless, the voice quality of such systems is unacceptable.

Orthographic text is the spelling of a spoken word. Phonetic text includes approximately 40 phonemes for translating orthographic English to phonetic English. A phoneme is an abstract unit that forms a basis for writing down a language systematically and unambiguously. Phonemes of a language are the minimal set of units that describe all and only the variations between sounds that cause a difference in meaning between the words of a language. For example, the /p/ and /t/ phonemes in the words "pin" and "tin" are distinctively different phonemes. However, audible speech includes numerous minor but significant and detectable differences between phonemes. Allophones are a subset of phonemes that include subtle but distinct differences between allophones of the same phoneme. That difference refers to the variant forms of the phoneme. For example, the aspirated /p/ of the word "pit" and the inspirited /p/ of the word "spit" are allophones of the phoneme /p/.

In the references described above, others have translated orthographic text to phonetic text. After that translation, the phonetic text is converted to audio signals using, pre-recorded phonemes and allophonic information. Pre-recorded phonemes are modified in accordance with different computer programs that alter the frequency, pitch, cadence, and rhythm of the phoneme in order to add allophonic information to the recorded phoneme and generate a truer audio representation of the input text. However, those prior art systems have complex software and have failed to provide acceptable reproductions of human voice for operator assistance services. Accordingly, there is a long felt need for a reliable and less complex system which accurately produces audio signals representative of input orthographic text.

SUMMARY

The invention provides a method and an apparatus that builds output audio signals representative of input phonetic transcrpts. The apparatus includes a computer that has a central processing unit with random access memory and read only memory. The memories hold an operating systems program and one or more application programs. A builder extracts a phonetic transcription of a desired word from an existing phonetic transcription database. Such databases are conventional and well-known. The builder operates a rules program for converting the phonetic transcritps to a string of allophonic text. After conversion, the builder extracts audio allophones from another database that comprises audio allophones stored in accordance with allophonic text characters. The audio allophone database includes pre-recorded allophonic audio signals that are taken from words spoken by the voice talent. The builder includes means for concatenating the extracted allophonic audio signals to generate an output audio signal that is representative of the input phonetic transcriptions.

With the invention, a voice talent records a number of words or phrases that include all of the audio allophones that correspond to the allophonic text characters. The recorded words are divided into individual allophones that correspond to the allophonic transcriptions in order to build an database of audio allophone files where each audio allophone file corresponds to an allophonic transcription. When the operator of the system desires a new word that was never spoken by the original voice talent, the operator provides a phonetic transcription of the word. The rules program in the builder converts the phonetic transcription into an allophonic text string. Then the builder searches the audio allophone database to retrieve those audio allophone files that correspond to the string of allophonic text. The audio allophone files are concatenated and stored as a new word. The new word may also by put into an output file for incorporation into a new or modified announcement.

DESCRIPTION

FIG. 1 is a block diagram of the allophonic text-to-speech generator.

DETAILED DESCRIPTION

Figure 1:
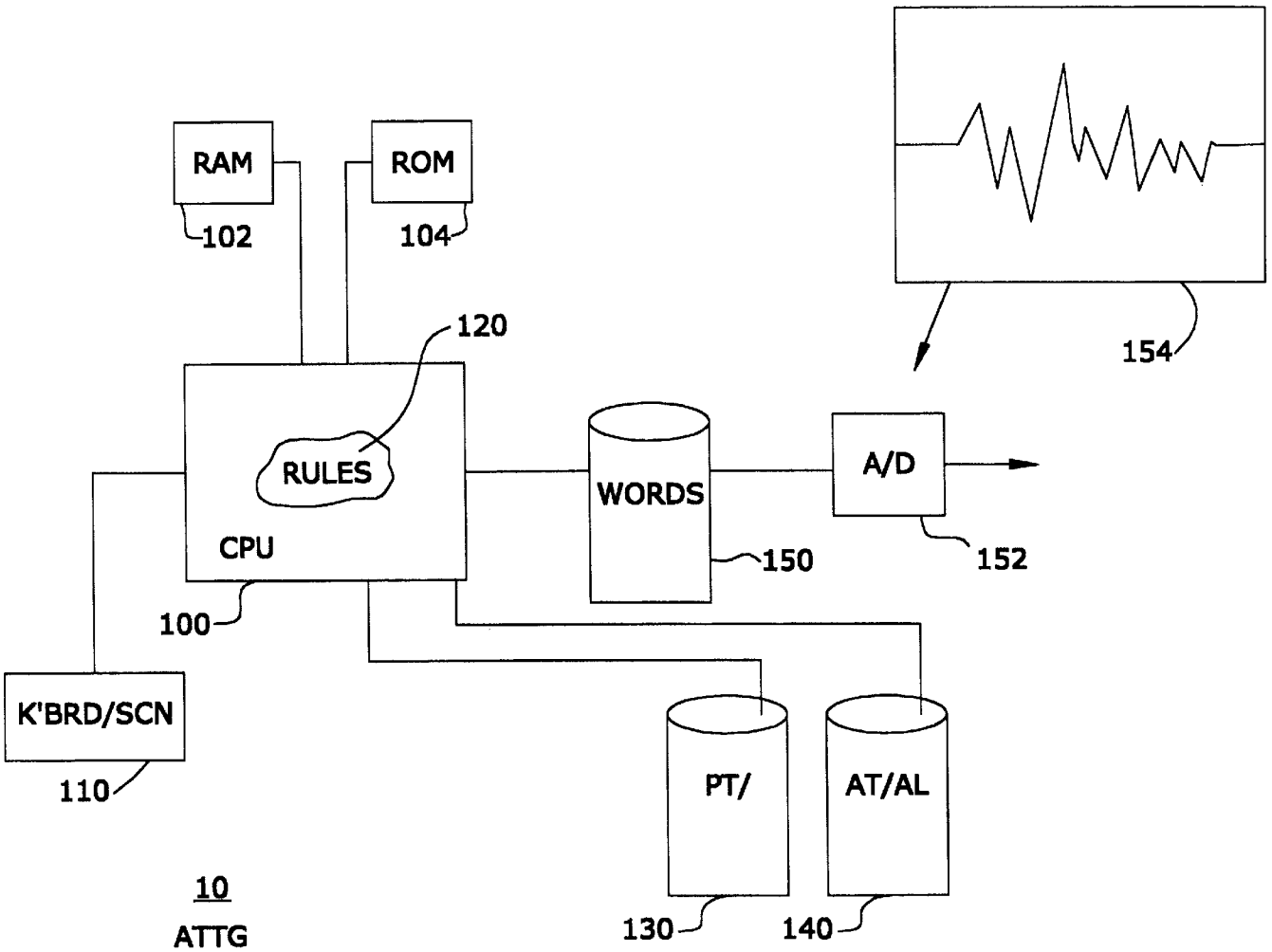

The allophonic text-to-speech generator (ATTG) 10 includes a CPU 100. The CPU has a random access memory 102 and a read only memory 104 for holding the operating system, application programs, and data for the CPU 100. A keyboard 110 provides a user with control over the CPU 100. A database 130 holds phonetic transcritps of words. Such databases are well-known in the field of telephone directory assistance. A second database 140 holds pre-recorded audio allophones. Each allophone is stored in accordance with the allophonic text to which the audio allophone corresponds. The prior art has used allophonic information to modify pre-recorded phonemes. In contrast, the invention uses allophonic text and maps the allophonic text to pre-recorded allophones. The CPU 100 converts a phonetic transcript to an allophonic text string using its rules program 120. The CPU 100 next extracts the pre-recorded allophones from the mapping file 140 that correspond to the allophonic text. Pre-recorded allophones are stored digital words that correspond to portions of spoken words that are parsed and stroed in accordance with their corresponding allophonic-text. The extracted audio allophone signals are concatenated in accordance with the string of allophonic text that in turn corresponds to the input phonetic transcriptions. The CPU 100 provides an output file 150 that comprises a concatenated string of allophonic sounds corresponding to a new word. When the digital audio file is converted to an analog file in A/D converter 152, the output sound is voice-like signal 154 of a new word.

Audio allophone database 140 is constructed by a voice actor who records a script that includes all of the allophones defined in the builder. Those allophones are recorded as separate words and phrases. The recording are divided into individual audio allophone files and each audio file includes an allophone that corresponds to an allophonic text. Each audio allophone is stored in file 140 accordance with its corresponding allophonic text. Phonectic transcriptions are stored in database file 130. The CPU 100 operates a rules program 120 that converts the phonetic text into a string of allophonic text. Rules for converting phonetic text to a allophonic text are shown in U.S. Pat. Nos. 4,979,216 and 5,463,715. After conversion, the audio allophone files are extracted from the database 140 in accordance with the corresponding allophonic text under which they are stored. The CPU 100 concatenates the allophone files to generate an output file 150 that corresponds to a new audio file for the desired word.

In order to demonstrate the feasibility of my invention, I recorded several words other than "cheese" and "incision" but which included all of the allophones in both words. I stored the pre-recorded allophones in an audio allophone file 140 in accordance with their corresponding allophonic text. I then typed a new allophonic text for "cheese" and "incision" and mapped the allophonic text to the stored allophones. I extracted the stored allophones corresponding to the allophonic text, concatenated them together, generated an output file, and converted the output file to audio signals. The output file represented a new word constructed from the allophones of earlier recorded words. The new word has the same "voice" as the original voice talent. The new file sounds surprisingly similar to normal pronunciation of the words "cheese" and "incision." When I used the simple phonemes for "cheese" and "incision" and concatenated the phonemes together, the resulting words were virtually unintelligible. My experiments indicate that it is practical to concatenate pre-recorded audio allophone files to generale new words.

With this invention one can create new words that were never spoken by the voice talent. The new words are constructed from pre-recorded allophones. The invention is used to add new names or words to announcement systems. For example, when a new name is added to a directory assistance system, the name may be constructed from the stored allophones. The new name will have the same "voice" as the voice of the original voice talent who spoke the words that were parsed into the audio allophone database. For example, if a new business known as INCISION is listed, the automatic directory assistance will have its script of names modified to add the new INCISION business to its list of names. The modification is made by extracting the phonetic text corresponding to "incision", converting the phonetic text to a corresponding allophonic text string, accessing the pre-recorded allophones corresponding to the allophonic text string, concatenating the audio files that correspond to the allophonic text string, and generating a new audio file of concatenated allophones that sounds similar to the spoken word, "incision." The new file is stored with other audio files of words, including pre-recorded words and created words. When a caller requests the telephone number for INCISION, the automatic directory assistance system enunciates a script, such as "The number for INCISION is 222-2222." The word "incision" is extracted from the files holding stored words for directory assistance.

Having thus described the preferred embodiments of the invention, those skilled in the art will appreciate that further modifications, additions, changes and deletions may be made thereto without departing from the spirit and scope of the inventions as set forth in the following claims.

What is claimed is:

1. A text processor for a text-to-speech synthesizer comprising:

a computer including a central processing unit having random access memory and read only memory for holding an operating system program and one or more application programs;

a phonetic text database for storing phonetic transcriptions corresponding to phonemes;

means for accessing the phonetic database to retrieve phonetic text characters corresponding to a desired word;

program means for converting the phonetic text characters into allophonic text characters to generate a string of allophonic text characters corresponding to the desired word;

an audio database comprising pre-recorded allophones stored in accordance with the allophonic text representative of each of said allophones;

means for extracting from the audio database the allophonic audio signals that correspond to the string of allophonic text in the desired word; and means for concatenating the allophonic audio signals together to generate a new audio file corresponding to the desired word.

2. The text processor for a text-to-speech synthesizer of claim 1, further comprising an application program comprising a plurality of rules for mapping phonetic text to allophonic text.

3. The text processor for a text-to-speech synthesizer of claim 1, wherein the allophonic text file comprises a plurality of allophonic text characters for each phonetic text character.

4. A method for building speech from text with a computer including a central processing unit having random access memory and read only memory for holding an operating system program and one or more application programs, comprising the steps of:

inputting phonetic text characters corresponding to a desired spoken work;

mapping the phonetic text characters to allophonic text characters to generate a string of allophonic text characters;

providing a file of prerecorded audio signals comprising allophonic audio signals corresponding to the allophonic text characters;

extracting from the file of prerecorded audio signals the allophonic audio signals that correspond to the string of allophonic text characters; and concatenating the allophonic audio signals together and generating an output audio signal representative of the input orthographic text.

5. The method of claim 4 wherein the audio file comprises a plurality of digital words, each word corresponding to an allophonic audio signal and the further step of converting concatenated allophonic digital audio words into analog audio signals.

6. The method of claim 4 wherein the allophonic text file comprises a plurality of allophonic text characters for each phonetic text character.

* * * * *